United States Patent [19]

Kelley et al.

[11] 4,453,879

[45] Jun. 12, 1984

[54] ANTI-JAM BLADE ASSEMBLY FOR REFUSE COMPACTOR

[76] Inventors: David E. Kelley; Willis K. Quick, both of 2700 NW. 48 St., Pompano Beach, Fla. 33067

[21] Appl. No.: 337,204

[22] Filed: Jan. 5, 1982

[51] Int. Cl.[3] ..... B65F 3/20

[52] U.S. Cl. ..... 414/509; 100/295

[58] Field of Search ..... 414/509–517, 414/525 R; 100/240, 245, 295; 198/743, 746

[56] References Cited

U.S. PATENT DOCUMENTS

| | | | |
|---|---|---|---|
| 2,693,890 | 11/1954 | Bridge | 414/509 |
| 2,912,128 | 11/1959 | Kamin | 414/509 X |
| 3,228,545 | 1/1966 | Bollinger et al. | 100/295 X |
| 3,672,520 | 6/1972 | Linville | 414/525 X |
| 3,771,675 | 11/1973 | Herpich et al. | 414/509 |

*Primary Examiner*—Leslie J. Paperner
*Attorney, Agent, or Firm*—Sughrue, Mion, Zinn, Macpeak & Seas

[57] ABSTRACT

An anti-jam blade assembly is provided on a packer-ejector blade of a refuse vehicle. The packer-ejector blade comprises a superstructure to which there is attached a downwardly inclined face. The superstructure and downwardly inclined face are reciprocated within a refuse vehicle receptacle. The anti-jam blade assembly to which this invention pertains comprises box-like elements hingedly attached to the superstructure and the blade assembly. The box-like elements are spaced apart and hingedly attached by brackets or the like to the downwardly inclined face. Springs are used to maintain the box-like elements in upward orientation and in the same plane as the superstructure. Upon an article becoming positioned between the box-like elements and the roof of the vehicle receptacle, the box-like elements will pivot forwardly thus decreasing pressure on the article and preventing jamming of the blade assembly. The article will become dislodged by drawing back on the blade assembly whereby the box-like elements will slide over the article which will be released and fall into the vehicle receptacle.

4 Claims, 4 Drawing Figures

ANTI-JAM BLADE ASSEMBLY FOR REFUSE COMPACTOR

BACKGROUND OF THE INVENTION

1. Field of the Invention

This invention pertains to packer-ejector blades for use in refuse vehicles. The invention is for use in an environment which includes a blade assembly having a blade, and a housing including a roof, and with means for facilitating un-jamming of the blade when articles become lodged between the blade and the inside roof of the vehicle.

2. Statement of the Prior Art

The prior art discloses hinged blades for use on vehicles to facilitate packing and unloading the vehicles. None show an anti-jam assembly which is pivotally attached to a packer-ejector blade used to compact refuse within the housing of a refuse vehicle. Representative of the prior art are U.S. Pat. Nos. 2,693,890 and 2,912,128.

SUMMARY OF THE INVENTION

This invention provides an anti-jam blade assembly for refuse vehicles which is easily installed on existing packer-ejector blades and which will permit un-jamming of the blade quickly thus reducing down time which occurs when articles become lodged between the blade assembly and the inside roof of the refuse vehicle.

It is another object of this invention to provide a top box assembly for a packer-ejector blade of a refuse vehicle which is pivotally attached to the blade thus decreasing the pressure on articles caught between the box top and the roof of the vehicle.

It is yet another object of this invention to provide a pivotal box top assembly which is hingedly attached to the upper blade structure in a manner that will facilitate release of articles which occasionally become lodged between the blade and the inside roof of the vehicle.

It is still another object of this invention to provide a pivotal anti-jam assembly which is spring biased to permit the assembly to be pulled away from an article lodged between the blade and the roof of the vehicle thus allowing the article to fall whereby the blade will become unjammed. The anti-jam assembly will snap back into upright position upon release of the article.

These and other objects of the invention will become apparent to those skilled in the art to which this invention pertains from a consideration of the specification when read in conjunction with the annexed drawings.

DESCRIPTION OF THE PREFERRED EMBODIMENT OF THE INVENTION

Figure 1:
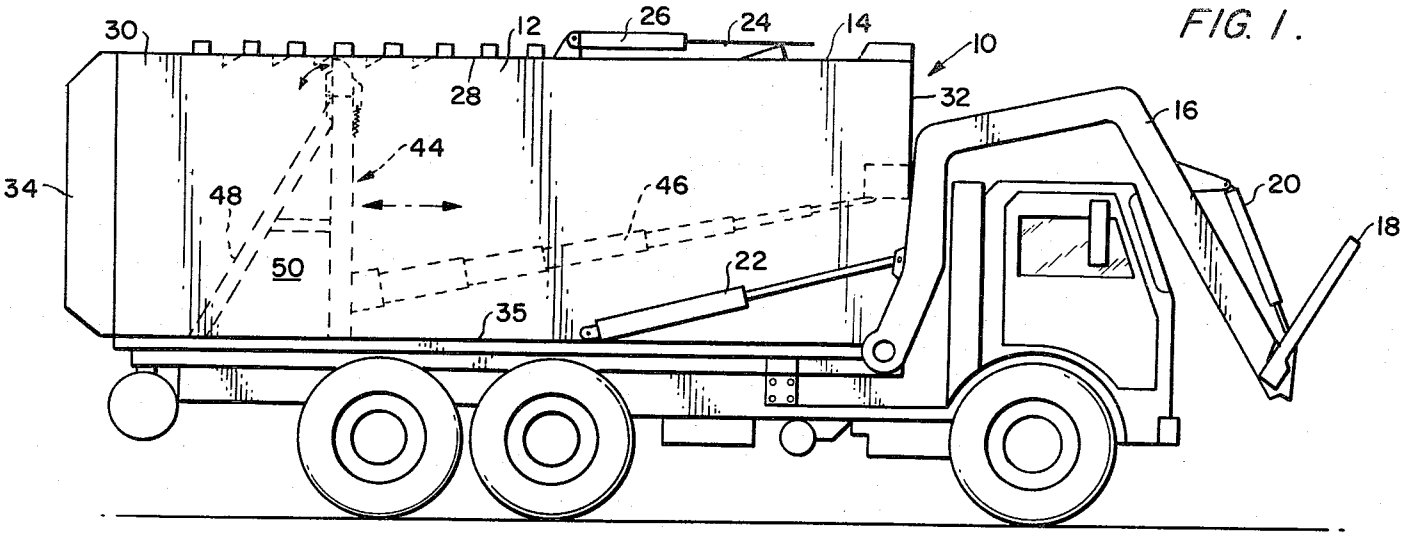
FIG. 1 is a cut-away side view of a refuse vehicle showing the packer-ejector blade and the anti-jam assembly attached thereto.

Referring now in more detail to the drawings, FIG. 1 shows a refuse vehicle 10 having a generally closed receptacle or housing 12 except for an opening 14 adjacent one end thereof to permit charging of the receptacle. The vehicle is equipped with a lifting mechanism 16 having arms 18 for engaging a portable container of the type usually found outside restaurants, stores and the like for receiving refuse. As is well-known, the lift mechanism 16 is operated by hydraulic rams 20 and 22 whereby the container (not shown) is raised and tilted until the contents thereof gravitate through the opening 14 into the vehicle receptacle. Opening 14 has a door 24 which is moved backwardly and forwardly to open and close the opening by means of hydraulic cylinders 26.

The vehicle 10 has a roof 28, side walls 30 (one shown) a front wall 32, a rear wall 34 and a floor 35. A bar 40 having angular teeth 42 is attached to the roof, centered between the side walls 30 and extending from the front to the rear of the vehicle. The teeth 42 have vertical edges 43 which serve to hold refuse in a compact manner within the vehicle receptacle as the refuse is pushed to the rear 34 by a blade assembly 44 reciprocated within the vehicle receptable by a hydraulic ram 46. The blade assembly 44 has a forwardly downwardly slanting face 48 attached to a support superstructure 50. It will be appreciated that the blade assembly 44 is a close fit within the confines of the walls, floor and roof of the vehicle receptacle. It also will be appreciated that the blade assembly 44 will be positioned against the front wall 32 as refuse is charged into the vehicle receptacle through opening 14.

The superstructure 50 of blade assembly 44 comprises end beams 52, 54 and central beams 56, 58. A beam 60 is attached to and spans the beams 52, 54, 56 and 58 at the tops thereof. An angle iron 62 is secured between the central beams 56, 58 and has attached thereto ends of eye bolts 64, 66.

The anti-jam assembly consists of a flat bar 68 to which there are attached a number of box-like elements 70, 72, 74, 76 which are comprised of side walls 78, 80 (only one box will be described), a rear curved wall 82 and a front vertical wall 84. The bottom edges 86 (only one described) of the various walls are secured to the bar 68 by any suitable means such as welding. The box-like elements are so arranged that spaces 90, 92 and 94 are provided between same. The spaces will be as wide as the width of the teeth 42 and possibly wider. Each box-like element will be secured to the blade assembly 44 by a series of spaced brackets 100, 102 (only one set to be described) attached to the front walls 84 by suitable means. The ends 104, 106 of the brackets are apertured as shown. The various brackets 100, 102 mate with plates 110, 112, 114 and 116 which are secured to top beam 60 and the front face 48 by any suitable means such as welding or the like. The ends of the plates are apertured as shown. The apertures of the brackets and plates are aligned and pintles 120 are inserted therethrough whereby the box-like elements may pivot relative to the blade assembly 44. It will be appreciated that all of the box-like elements may pivot in unison as per the above mentioned construction or they may be individually pivotally attached to the blade assembly 44.

The box-like elements so described are spring biased to the blade assembly 44 by means of springs 130, 132 which are attached at their ends to angle members 124 and 126 which are welded to the bar 68. The opposite ends of the springs 130, 132 are attached to the eye bolts as shown.

Figure 4:
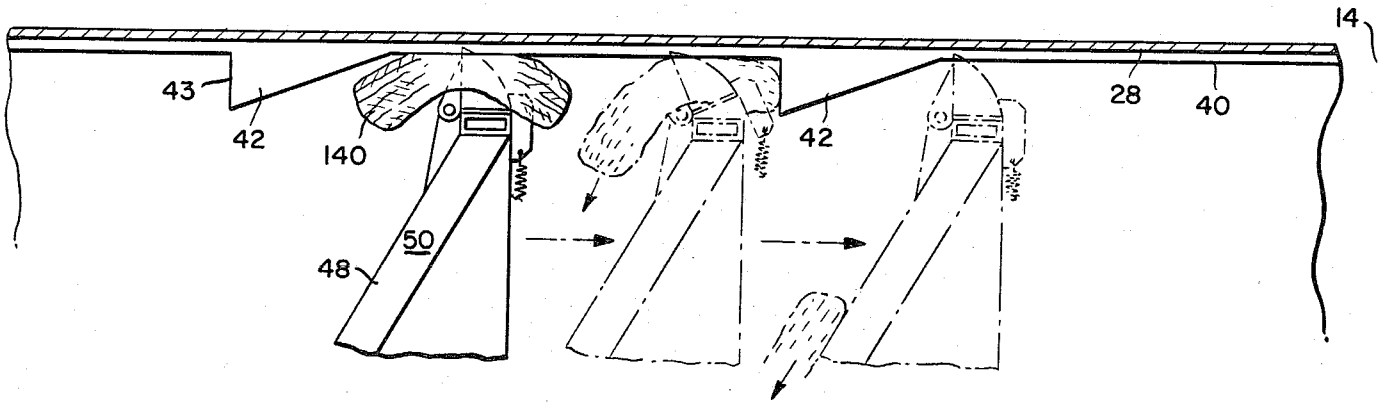
FIG. 4 is an enlarged side view of the anti-jam assembly showing an article caught between the assembly and the roof of the vehicle.
Figure 2:
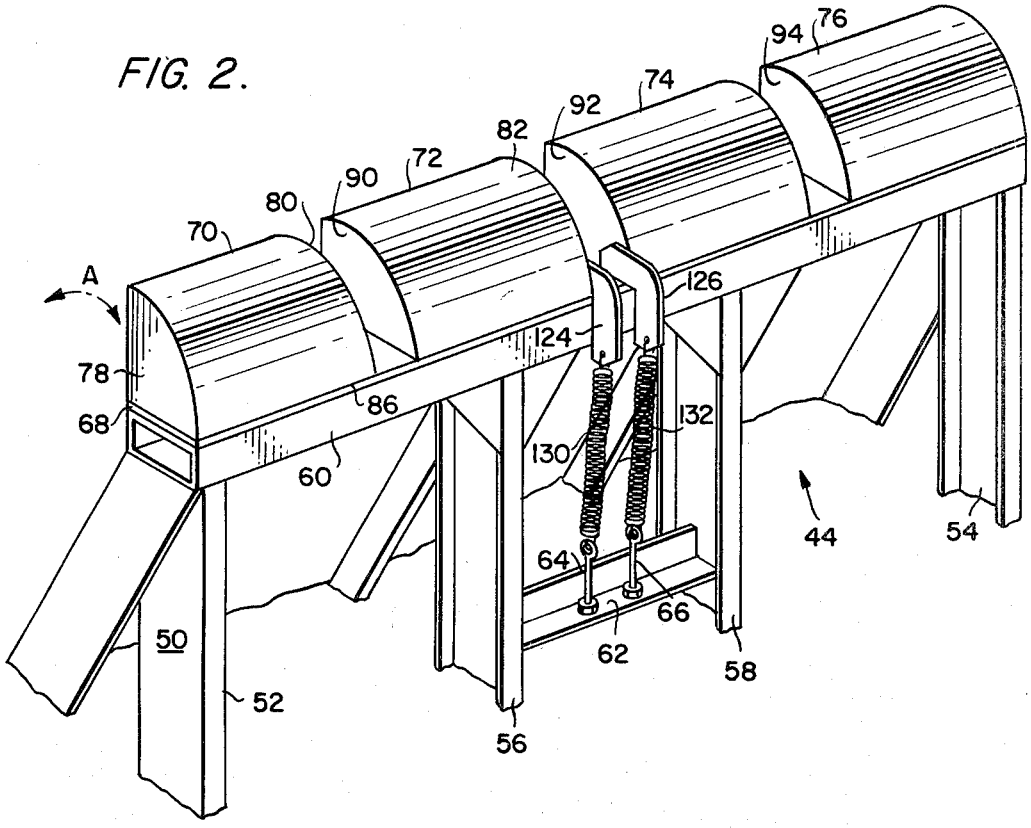
FIG. 2 is a perspective rear view of the anti-jam assembly spring biased to the packer-ejector blade.
Figure 3:
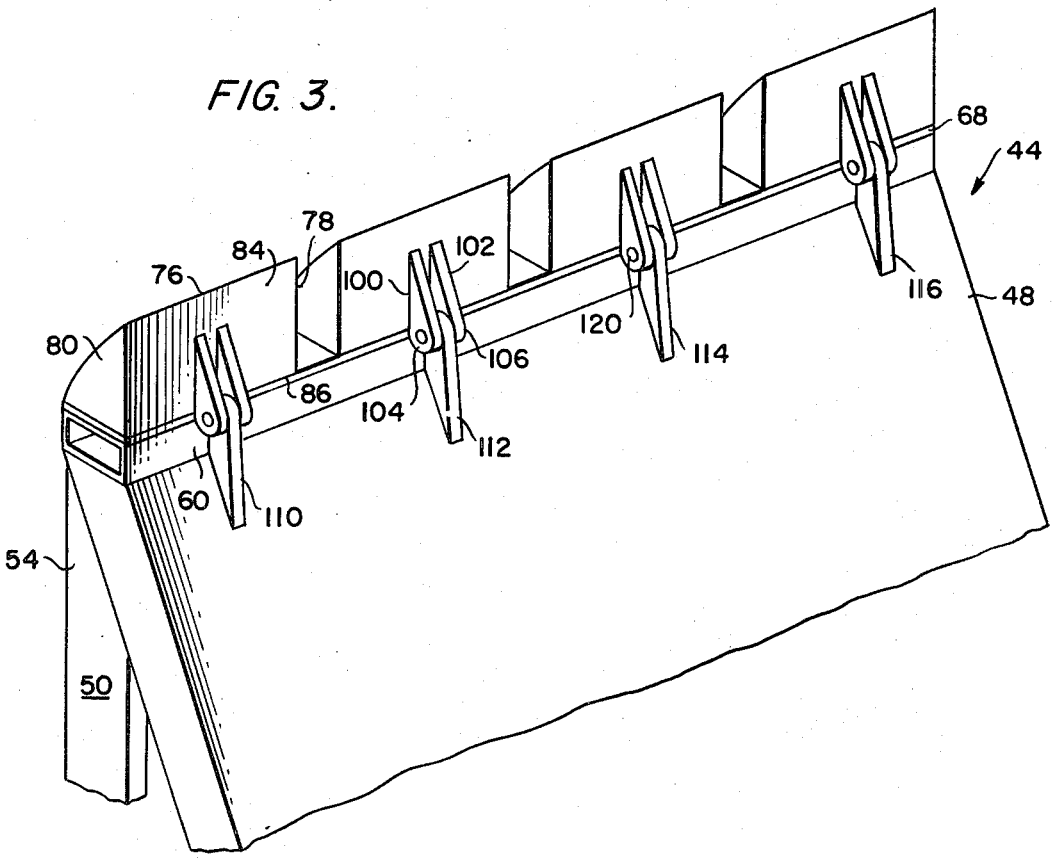
FIG. 3 is a perspective front view of the anti-jam assembly showing the means by which the assembly is connected to the packer-ejector blade.

In operation, the packer-ejector blade assembly 44 with the anti-jam box-like elements attached thereto is movable within the vehicle receptacle in the usual manner as shown in FIG. 4. After a refuse container has been discharged into the vehicle receptacle through the opening 14, the packer-ejector blade assembly 44 with box-like elements attached thereto is moved rearwardly toward the rear wall 34 by the hydraulic cylinder 46 thus packing the refuse against rear wall 34. As the packing proceeds, it often occurs that an article such as a discharged pneumatic tire 140 will become caught between one or more of the box-like elements and the roof of the refuse container. However, since the box-like elements are pivotally attached to the blade assembly, it is a relatively simple matter to release the pneumatic tire by drawing back the blade assembly 44 thus causing the box-like assembly to pivot against the pressure of the pneumatic tire. Continued rearward motion of the blade assembly 44 will cause the box-like assemblies to pivot rearwardly thus decreasing pressure on the pneumatic tire which will then become released. Upon the release of the article, the springs 130, 132 will cause the box-like elements to snap back to an upright position. Thereafter, the blade assembly may be moved rearwardly to continue the packing process. It will be readily apparent that this structure will permit continuous operation of the packing process with minimum or no down time.

While the invention has been shown and described with respect to the preferred embodiment thereof, it will be understood by those skilled in the art to which this invention pertains that the foregoing description is intended to be an example and that the anti-jam assembly may be changed in form and detail without departing from the spirit and scope of the invention.

What it claim is:

1. An anti-jam blade in combination with a refuse vehicle, the vehicle comprising:

a closed refuse receptacle having an opening in the top thereof, lifts means for raising and tilting a refuse container containing refuse whereby the contents of said container are discharged through the top opening into the vehicle receptacle, and packer-ejector blade means for compacting said refuse, the improvement comprising:

a plurality of box-like elements hingedly attached in spaced apart relationship to an upper edge of the packer-ejector blade whereby said box-like elements pivot rearwardly when articles become jammed between the roof of the vehicle receptacle and the box-like elements and upon drawing of the packer-ejector blade forwardly the articles are released into the vehicle receptacle; and spring means for maintaining said box-like elements in vertical orientation relative to the upper edge of the packer-ejector blade.

2. An anti-jam blade assembly as defined in claim 1, wherein:

said box-like elements have side walls, front walls and curved rear walls, the edges of which are secured to a support, said box-like elements and support are hingedly attached to the ejector blade by comrporating brackets and plates.

3. An anti-jam blade assembly in combination with a refuse vehicle, the refuse vehicle comprising a generally closed receptacle, a blade assembly reciprocal within the receptacle, a toothed bar on the inside roof of the receptacle for holding refuse in compact form, the improvement comprising:

plural spaced apart box-like elements having side walls, curved rear walls and flat vertical front walls secured to a flat plate on an upper edge of the blade assembly, said vertical front walls having bracket thereon for pivotal engagement with stationary elements on the blade, said box-like elements being spring biased against said blade in such fashion that said box-like elements are pivotally urged away from the roof of the vehicle upon an article becoming positioned between said box-like elements and the roof of the vehicle receptacle thus preventing jamming of the blade assembly.

4. An anti-jam blade assembly for use with refuse vehicles comprising:

a superstructure;

a downwardly inclined face on the superstructure;

plural spaced apart box-like elements on an upper edge of the superstructure and having vertical front walls oriented in a plane intersecting the downwardly inclined face on the superstructure, side walls and curved rear walls on the box-like elements;

means for hingedly attaching said box-like elements to the upper edge of the superstructure;

springs for maintaining said box-like elements in vertical orientation and in the same plane as the superstructure; and said box-like elements being pivotal against the springs upon encountering an object which may be positioned between said box-like elements and the roof of the vehicle receptacle thus decreasing the pressure between the roof, article and box-like elements, and upon forward movement of the blade assembly the article is released to fall free.

* * * * *